US005667844A

United States Patent [19]

Smith et al.

[11] Patent Number: 5,667,844

[45] Date of Patent: Sep. 16, 1997

[54] TOOL TREATING PROCESS

[75] Inventors: Morton R. Smith, Napoleon; James L. Maassel, New Bavaria, both of Ohio

[73] Assignee: Macro Specialty Industries, Inc., Napoleon, Ohio

[21] Appl. No.: 684,882

[22] Filed: Jul. 25, 1996

[51] Int. Cl.[6] ..... B05D 3/02

[52] U.S. Cl. ..... 427/318; 427/309; 427/327; 427/345; 427/398.1; 427/430.1; 427/435; 427/443.2

[58] Field of Search ..... 427/430.1, 435, 427/309, 318, 327, 345, 398.1, 443.2; 118/423, 429

[56] References Cited

U.S. PATENT DOCUMENTS

| | | | |
|---|---|---|---|
| 4,763,392 | 8/1988 | Fogal et al. | 427/435 X |
| 5,194,302 | 3/1993 | Ruehl | 427/430.1 X |
| 5,494,698 | 2/1996 | White et al. | 427/435 X |

*Primary Examiner*—Bernard Pianalto
*Attorney, Agent, or Firm*—Donald R. Fraser

[57] ABSTRACT

A process for treating cutting tools to extend the useful duty cycles of the tools by immersing the tools to be treated in a bath of a solvent in sufficient amounts and at a temperature to remove contamination from the surface of the tools and to coat the tool surfaces with perfluoroethylene. The solvent and perfluoroethylene resin are circulated throughout the immersed tools for a time sufficient to coat the surfaces with polyfluoroethylene resin.

9 Claims, 2 Drawing Sheets

TOOL TREATING PROCESS

This application is filed under the provisions of 35 U.S.C. 111(a) and claims the benefits of a provisional application Serial No. 60/005,162 filed Oct. 13, 1995 under the provisions of 35 U.S.C. 111(b).

FIELD OF THE INVENTION

The present invention relates generally to a process and apparatus for extending the life of taps, drills, end mills, reamers, dies, forming tools, and other cutting tools.

BACKGROUND OF THE INVENTION

It is well known that cutting tools such as, for example, drills are used to form holes in an engine block. Typically, it has been found to be rather standard that drills used in forming holes in the engine block require changing after three (3) shifts. During a three shift period, for example, 4800 pieces or holes can be accomplished. The tools are typically replaced with new drills or drills that have been sharpened.

It is most opportune if the drills last up until a shift change during which time the tools can be changed. However, oftentimes, the tools need changing at a period during a shift. This leads to a rather consequential inefficiencies.

SUMMARY OF THE INVENTION

Accordant with the present invention, it has been discovered that unexpectedly long duty cycles can be lent to cutting tools, such as the present example, by treating the cutting tool after sharpening with the following novel process, comprising the steps of:

1) placing the tool to be treated into a first heated bath containing a solvent to cause the solvent to remove any extraneous matter from the surfaces of the tool within the bath;
2) placing the cleaned and heated tool into a second bath containing a mixture of a solvent and a perfluoroethylene resin;
3) circulating the second bath for a time sufficient to remove extraneous matter from the surface of the tool within the bath and to coat the surface of the tool with perfluoroethylene resin; and
4) removing the tool from the second bath and permitting the tool to return to ambient temperature.

It is therefore an objective of the invention to provide a process for producing tools having extended duty cycles compared to those tools which were not treated by the process.

BRIEF DESCRIPTION OF THE DRAWINGS

The above, as well as other objects and advantages of the present invention, will become readily apparent to those skilled in the art from the following detailed description of a preferred embodiment of the invention when considered in the light of the accompanying drawing, in which.

DETAILED DESCRIPTION OF A PREFERRED EMBODIMENT OF THE INVENTION

Figure 1:
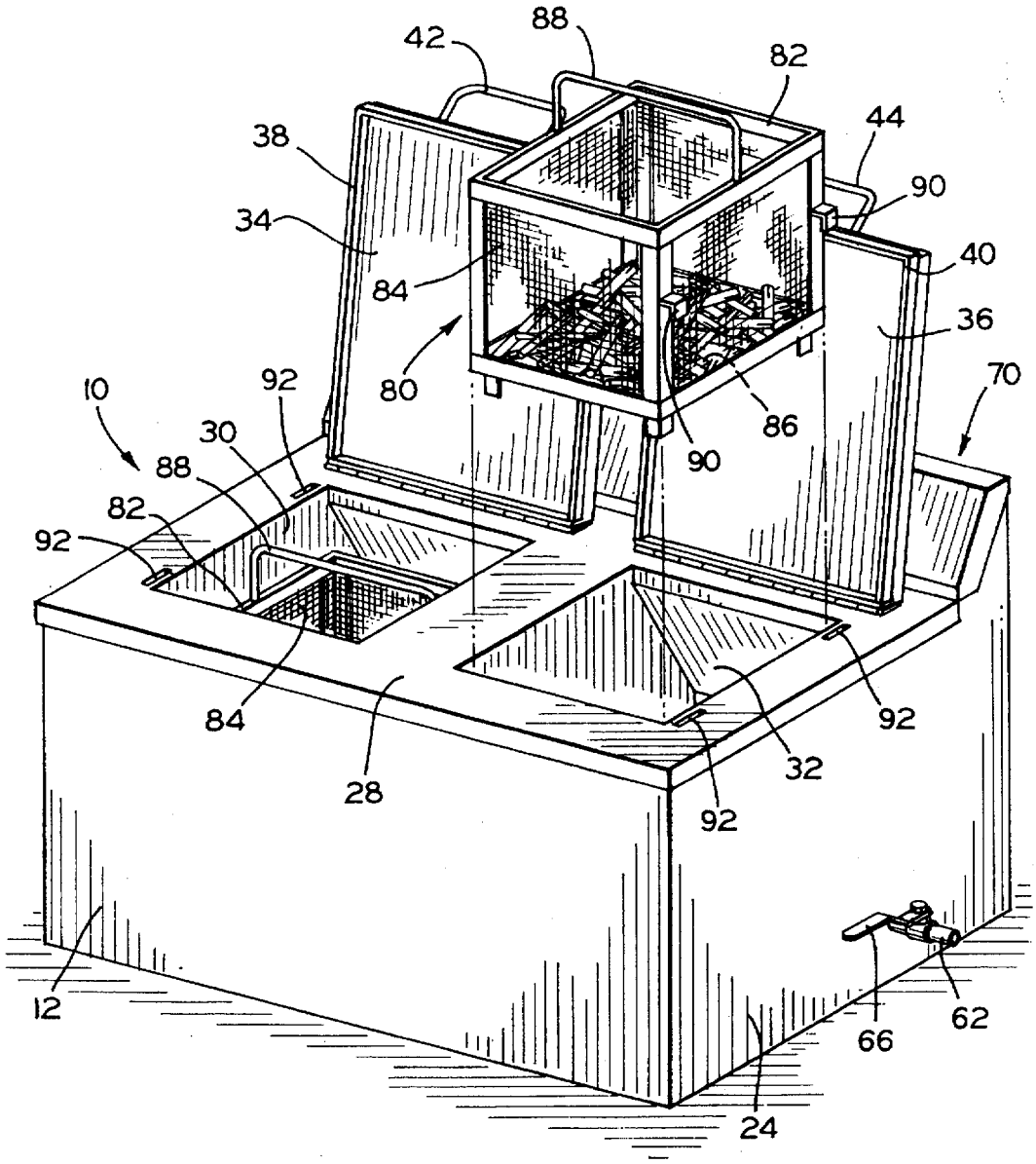
FIG. 1 is a perspective view of a vessel for carrying out the steps of the inventive method of treating cutting tools.
Figure 2:
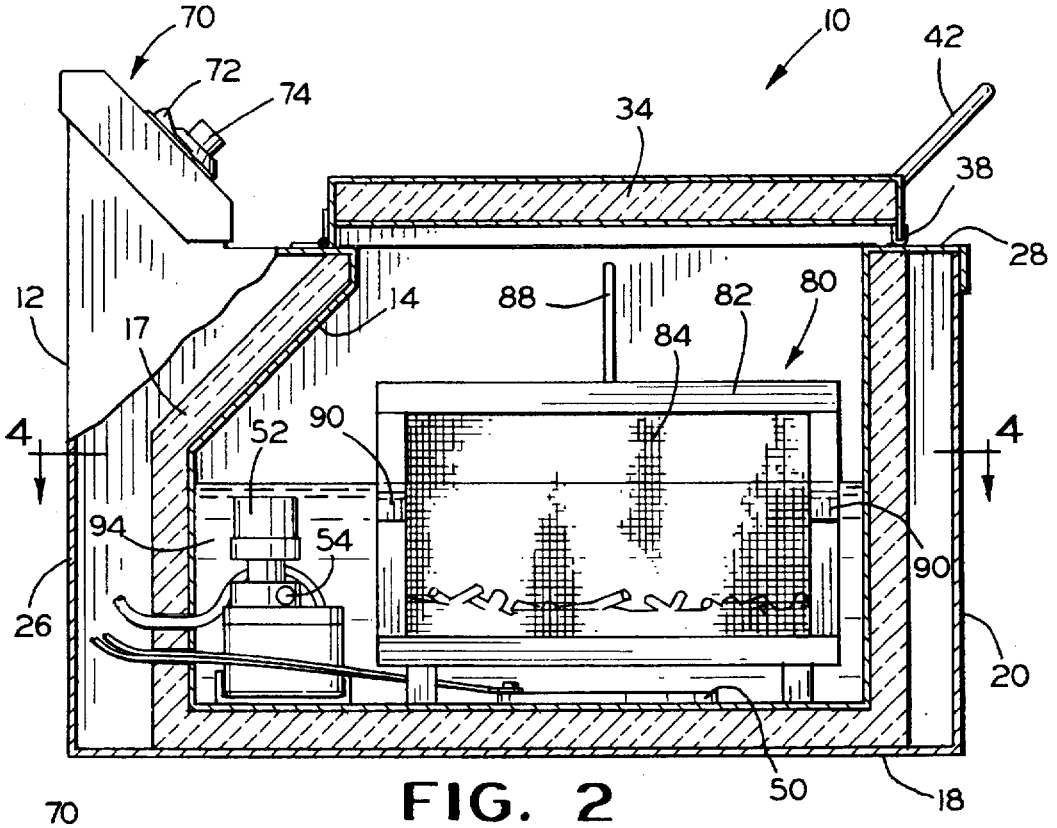
FIG. 2 is a sectional view of the apparatus illustrated in FIG. 1 taken along line 2—2 thereof.
Figure 3:
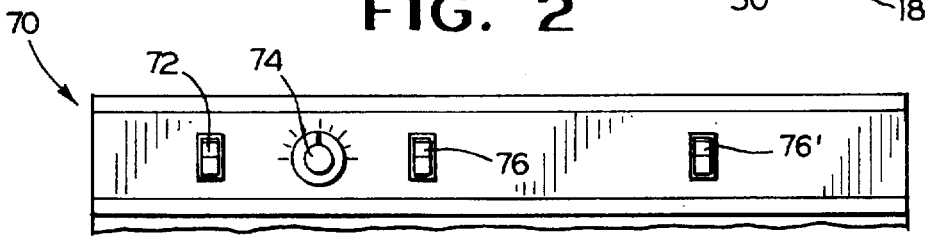
FIG. 3 is a fragmentary view of the control panel of the vessel illustrated in FIGS. 1 and 2.
Figure 4:
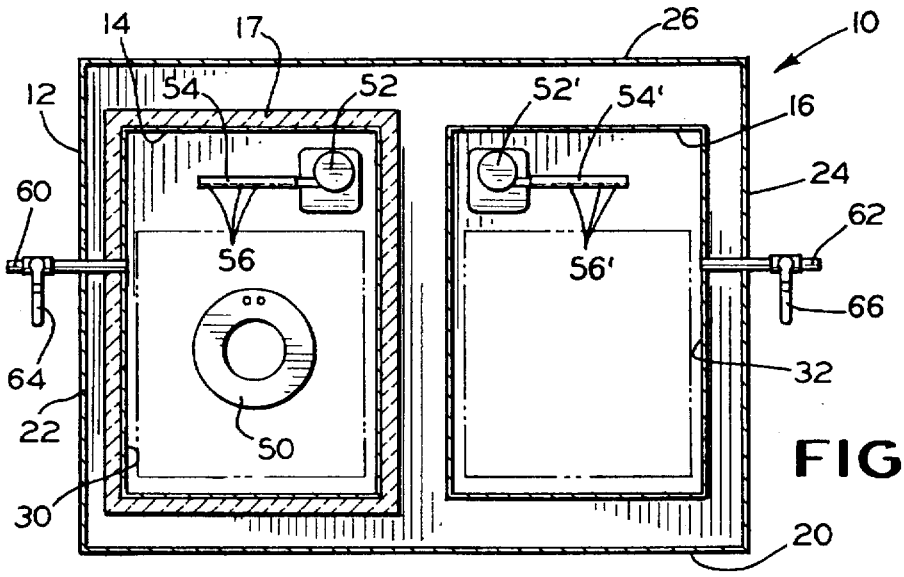
FIG. 4 is a sectional view of the vessel, illustrated in FIG. 2 taken along line 4—4 thereof.

The process according to the present invention may be practiced in any environment capable of containing the tools to be treated along with a quantity of the treating fluid enveloping the tools at a temperature suitable to achieve the desired reaction between the tools and the treating fluid.

Referring to the drawings, there is illustrated a preferred vessel 10 which is provided with an outer wall 12 and a spaced apart inner wall 14 defining a first inner reservoir and an inner wall 16 defining a second inner reservoir. The first inner reservoir is provided with a suitable insulating material 17 disposed between the outer wall 12 and inner wall 14. The outer wall 12 includes a base 18, a front wall 20, side walls 22, 24, rear wall 26, and top wall 28 having spaced apart openings 30, 32. The openings 30, 32 communicate with the first inner reservoir and the second inner reservoir, respectively.

Suitable insulated lids 34, 36 are provided for the openings 30, 32, respectively. The lids 34 and 36 are hingedly interconnected to the exposed surface of the top wall 28 by any suitable type hinge. Experience has indicated that piano-type hinge structure will function to achieve the desired results. Further, since the process is dependent upon the introduction of heat energy into the interior of the vessel 10, the lids 34, 36 are provided with insulating seals 38, 40, respectively, which extend around the periphery thereof and effectively retain heat energy within the vessel 10 when the lids are closed.

Handles 42 and 44 are attached to the lids 34 and 36, respectively, to facilitate the opening and closing thereof. If necessary, locking latches can be provided to limit access to the reservoirs.

It has been found that the desired results are typically achieved by forming the vessel 10 of stainless steel sheet material. The insulation 17 in the illustrated embodiment was a one inch thick sheet insulation having an R-factor of 4.3.

An electrically actuated heating element 50 is disposed within the first reservoir, as well as is a fluid circulating pump 52. The fluid circulating pump 52 is provided with an elongate outlet pipe 54 provided with a series of spaced apart outlets 56. The outlet pipe 54 is employed to effect an even distribution of the treating fluid as will be explained in more detail hereinafter.

The similar fluid circulating pump 52' is disposed in the second reservoir and is provided with a similar outlet pipe 54' having spaced apart outlets 56'.

Satisfactory results are achieved by selecting a heating element 50 which has a 1000 WATT/15 AMP rating. The pumps 52, 52' were selected to have the pumping capacity of 50–60 gallons per hour.

Each of the reservoirs; namely, the first and second reservoirs, is provided with a drain 60, 62 having manually operated a petcock 64, 66, respectively.

A control panel 70 is mounted at the upper rear of the top wall 28 at the uppermost end of the rear wall 26. The control panel 70 contains the electrical control circuitry for the heater 50, and the circulating pumps 52, 52'. More specifically, the control panel 70 includes an on/off switch 72 which is effective to control the electrical power from a line source to the heater 50. A dial 74 is connected to a potentiometer for varying the electrical current to the heater 50.

On/off switches 76, 76' mounted in the control panel 70 are effective to control the electrical current flow to the pumps 52, 52', respectively.

Baskets 80 are employed to hold the parts to be treated. The baskets 80 are formed with a rigid framework 82 and screen side walls 84 and bottoms 86. The open upper portion of the baskets 80 are provided with a readily graspable handle 88. Also, the baskets 80 are provided with outwardly extending fingers 90 attached to the framework 82. The fingers 90 are adapted to be received within appropriately positioned slots 92 formed in the upper wall adjacent the openings 30, 32 therein providing access to the first and second reservoirs, respectively. The fingers 90 are effective in holding the baskets 80 in an elevated position above respective reservoirs.

The framework 82 and the screen material of the sides 84 of the baskets 80 are typically formed of stainless steel, while the bottom 86 is formed of a brass mesh.

Prior to the start-up of the treating operation, the first reservoir is filled to an appropriate level with a solvent solution 94 which can be a naphthenic oil solvent available from Macro Specialty Industries, Inc., Napoleon, Ohio under the product designation of MSI Metal Treatment for Heating & Cleaning Solution 09621, for example. The second reservoir is typically filled to a similar level with a solution comprised of a suitable mixture of a solvent and resin. An aliphatic naphtha solvent and a perfluoroethylene resin have been found to achieve the desired treatment results and are mixed together in a preferred ratio of about sixty-one percent (61%) by volume aliphatic naphtha solvent with about thirty-nine percent (39%) by volume perfluoroethylene resin such as commercially sold under the product name of MSI Tool Kote (09623) manufactured by Macro Specialty Industries, Inc., Napoleon, Ohio which has been found to produce satisfactory results. The switch 72 is then closed and the dial 74 is set to the desired setting, and the solution 94 is heated by the heater element 50 to the preferred temperature of 140° F.

The treating operation is then commenced by placing the parts to be treated in the basket 80 over the first reservoir. Once the basket 80 contains the desired quantity of parts to be treated, the basket 80 is lowered into the first reservoir such that the parts are completely submerged in the treating solution 94.

As soon as the parts have reached the desired temperature, the basket 80 and the immersed parts are lifted out of the first reservoir and the basket 80 is lowered into the second reservoir containing the mixture of solvent and resin. The switch 76' is closed to thereby energize the circulation pump 52' causing the mixture of solvent and resin to be circulated through the second reservoir. Agitation and circulation of the mixture through the parts and across the surfaces thereof is typically continued with the temperature of the parts being treated reaches approximately ambient temperature 70°–75° F.

As an alternative procedure, the switch 76 can be actuated causing the heated treating solvent in the first reservoir to flow around the immersed parts to contaminant therefrom. However, this supplemental agitation and circulation of the solvent in the first reservoir has been found to not always be necessary.

In certain instances, it may be desirable to employ a chiller mechanism in the second reservoir to even further expedite the cooling of the treated parts.

In any event, once the temperature of the heated parts has returned to the ambient temperature, the basket 80 containing the treated parts is raised to a position where the fingers 90 of the basket 80 are received within the slots 92 to allow the excess treating fluid to return to the reservoir 32. Finally, the parts are allowed to air dry before use.

It has been mentioned that the preferred treating temperature of the treating fluid in the first reservoir was 140° F. It will be understood that acceptable results may be achieved with a temperature range of from 120° F. to 160° F. depending upon the type of metal of the parts being treated.

It will be understood that the aforedescribed process may be used to treat new or resharpened machine cutting tools, such as drill bits, end mills, taps, and the like. In one example, twelve 0.625 inch diameter brazed carbide tipped drills with a TIN coating were treated as outlined above. It was unexpectedly discovered that the treated drills had a useful duty cycle of five times the duty cycle of an untreated drill.

In accordance with the provisions of the patent statutes, the present invention has been described in what is considered to represent its preferred embodiment. However, it should be understood that the invention can be practiced otherwise than as specifically illustrated and described without departing from its spirit or scope.

What is claimed is:

1. A process for treating a cutting tool, comprising the steps of:

a) placing the tool to be treated into a first bath of solvent;

b) heating the bath of solvent to remove contaminant from the surfaces of the tool within the bath of solvent;

c) placing the tool in a second bath of a perfluoroethylene resin;

d) circulating the second bath of perfluoroethylene resin for a time sufficient to coat the surfaces of the tool with perfluoroethylene resin; and e) removing the tool from the second bath to permit the tool to return to ambient temperature.

2. The process according to claim 1 wherein the perfluoroethylene resin is circulated throughout the second bath for at least one-half hour.

3. The process according to claim 1 wherein the solvent comprises an aliphatic naphtha solvent.

4. The process according to claim 1, wherein the perfluoroethylene resin comprises a polytetrafluoroethylene resin.

5. A process as defined in claim 1 wherein the solvent is heated to a temperature within the range of from 120° F. to 160° F.

6. A process as defined in claim 1 wherein the solvent is heated to approximately 140° F.

7. A process as defined in claim 1 wherein step a) includes heating the tool to be treated prior to immersing the tool in a bath of solvent.

8. The process as defined in claim 1 wherein step b) includes circulating the bath of solvent to cause the solvent to flow over the surfaces of the tool.

9. The process as defined in claim 1 wherein step e) includes the chilling of the tool to accelerate the return to ambient temperature.

* * * * *